US005249982A

United States Patent [19]

Funck et al.

[11] Patent Number: 5,249,982

[45] Date of Patent: Oct. 5, 1993

[54] PANEL MOUNTED ELECTRICAL CONNECTOR WITH IMPROVED SEALING SYSTEM

[75] Inventors: Gordon W. Funck, Naperville; Craig R. Pierce, Elburn; Raymond A. Silbernagel, Naperville; Edward S. Sommer, Addison, all of Ill.

[73] Assignee: Molex Incorporated, Lisle, Ill.

[21] Appl. No.: 998,111

[22] Filed: Dec. 29, 1992

[51] Int. Cl.[5] ..... H01R 13/52; H01R 13/74

[52] U.S. Cl. ..... 439/556; 439/557

[58] Field of Search ..... 439/548, 556, 559, 554, 439/552, 558, 557; 248/27.3, 221.4

[56] References Cited

U.S. PATENT DOCUMENTS

| | | | |
|---|---|---|---|
| 2,704,833 | 3/1955 | Heller | 439/556 |
| 2,731,613 | 1/1956 | Heller | 439/556 |
| 3,167,374 | 1/1965 | Healy | 439/588 |
| 3,753,212 | 8/1973 | Yamada et al. | 439/557 |
| 3,941,444 | 3/1976 | Bruni et al. | 439/556 |
| 5,044,986 | 9/1991 | Baumanis | 439/548 |
| 5,112,241 | 5/1992 | Chesnut et al. | 439/273 |
| 5,139,431 | 8/1992 | Saitoh et al. | 439/559 |

*Primary Examiner*—Gary F. Paumen

*Attorney, Agent, or Firm*—Stephen Z. Weiss

[57] ABSTRACT

A panel mounted, sealed electrical connector assembly is provided for mounting in an aperture in a panel. The assembly includes a connector housing having a front mating end adapted to be inserted through the aperture from a first surface to at least a second surface of the panel in order to mate with a complementary electrical component. Locking arms project from the housing to mount the housing in the aperture. A sealing boot engages the housing rearwardly of the first surface and extends toward and engages the panel surrounding the aperture. Resilient flanges surround a substantial portion of the periphery of the housing and are adapted to be biased against the first surface of the panel. The sealing boot includes a forward peripheral lip adapted to be received between the flanges of the housing and the first surface of the panel surrounding the aperture, whereby the flanges resiliently bias the lip against the first surface and provides an environmental seal about the aperture.

10 Claims, 2 Drawing Sheets

PANEL MOUNTED ELECTRICAL CONNECTOR WITH IMPROVED SEALING SYSTEM

FIELD OF THE INVENTION

This invention generally relates to the art of electrical connectors and, particularly, to a sealing system for sealing about an aperture in a panel which accommodates an electrical connector.

BACKGROUND OF THE INVENTION

There are a wide variety of electrical connectors which are mounted through an aperture in a panel and for coupling to a mating connector on a side of the panel opposite the direction of insertion of the connector. In some applications, it is desirable to close and seal the aperture in the panel to isolate the inner side of the panel from the outside environment, such as for moisture-proofing the arrangement. This often is accomplished simply by grommets which surround the connector and the edge of the aperture in the panel. The grommets may include body portions which surround and also provide protection for the connector itself, such as in the form of a boot.

Some panel mounted connectors also have latch means in the form of latch fingers for retaining the connector at a particular position relative to the aperture in the panel. Usually, the latch fingers on the connector engage the panel within the aperture therethrough. A sealing device, therefore, must accommodate these latch fingers and, consequently, a grommet extending through the aperture is impractical. In such applications, a sealing boot may surround the connector on the inside of the panel, with a peripheral sealing flange engaging the inside panel surface about the aperture in the panel and surrounding the connector and its latching fingers. The peripheral flange usually is flexible, and one of the problems in using such boots is to provide pressure which will maintain the flexible flange in sealing engagement with the panel surface. This may be accomplished by clamps, tape or the like, but such devices may become loosened and slippage occurs resulting in loss of the seal.

U.S. Pat. No. 5,044,986 to Baumanis, dated Sep. 3, 1991 and assigned the assignee of this invention shows a panel mounted, sealed electrical connector which is directed to solving these problems of providing an adequate seal by incorporating improved self-facilitating features in the sealing system.

On the other hand, attempts have been made to provide auxiliary pressure-backing means against the backside of the flexible peripheral flange of the sealing boot to maintain the flexible flange in sealing engagement with the panel surface. For instance, the connector housing may include rigid flanges which sandwich the peripheral flange of the sealing boot between the rigid flanges and the panel surface. However, such rigid backing flanges do not compensate for any irregularities in the panel surface and leakage may occur at particular points of irregularity about the periphery of the flexible flange of the boot. In fact, such rigid backing means may do more harm than good, versus a flexible peripheral flange, alone, which is allowed to flex about its entire periphery.

This invention is directed to solving the problems outlined above by providing further improvements in the sealing system of a panel mounted connector.

SUMMARY OF THE INVENTION

An object, therefore, of the invention is to provide a new and improved panel mounted, sealed electrical connector assembly for mounting in an aperture in a panel or the like.

In the exemplary embodiment of the invention, the connector assembly includes a connector housing having a front mating end adapted to be inserted through the aperture from a first surface to at least a second surface of the panel in order to mate with a complementary electrical component such as a complementary connector. Interengaging locking means are provided between the housing and the panel to mount the housing in the aperture. A sealing boot engages the housing rearwardly of the first surface and extends toward and engages the panel to surround and environmentally protect the aperture.

The invention contemplates the provision of resilient flange means surrounding a substantial portion of the periphery of the housing and which is adapted to be biased against the first surface of the panel. The sealing boot includes a flexible forward portion adapted to be received between the flange means of the housing and the first surface of the panel surrounding the aperture. Therefore, the flange means of the housing resiliently biases the flexible forward portion of the boot against the first surface of the panel to provide an environmental seal about the aperture in the panel.

As disclosed herein, the housing has a plurality of side walls, and the flange means are provided by a plurality of individual resilient flanges projecting outwardly from respective ones of the side walls. The flexible forward portion of the sealing boot is provided by a resilient lip surrounding the aperture and turned inwardly toward the housing between the first surface and the individual resilient flanges projecting outwardly from the housing side walls. The locking means are provided by a pair of locking members projecting from two side walls of the housing and extending through the resilient flanges of the housing for locking engagement with the panel at the periphery of the aperture.

Still further, the housing includes a rear end, and the sealing boot includes a rear portion surrounding the housing and adapted to rigidly embrace the rear end of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
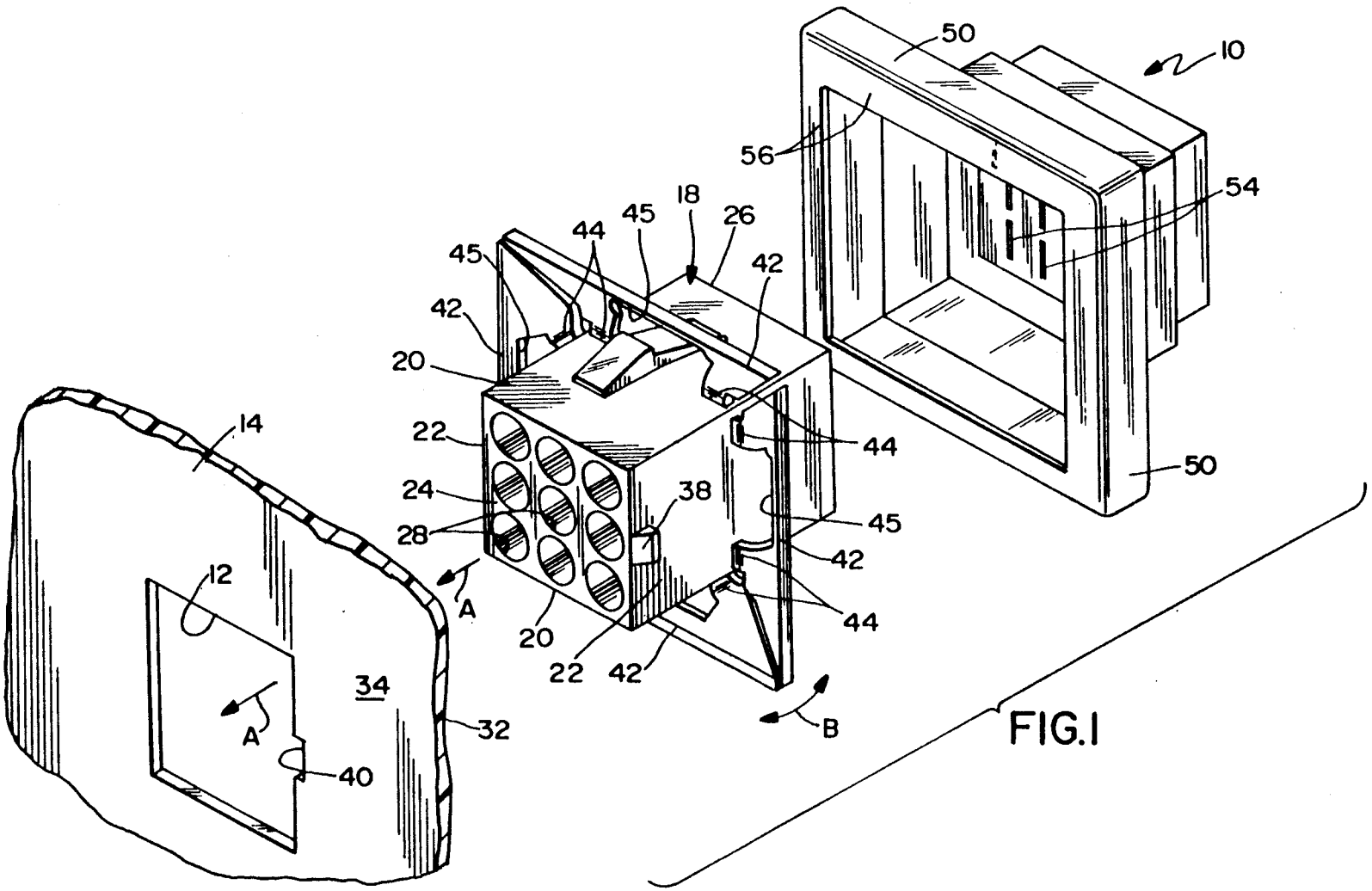
FIG. 1 is an exploded perspective view of a panel mounted, sealed electrical connector assembly embodying the concepts of the invention.

Referring to the drawings in greater detail, and first to FIG. 1, the invention is illustrated in a system which includes a sealing device or boot, generally designated 10, for closing an aperture 12 in a panel 14 which accommodates an electrical connector, generally designated 16.

Electrical connector assembly 16 includes a dielectric connector housing, generally designated 18, which is unitarily molded of insulating material such as plastic or the like. The housing is generally rectangular in configuration, as defined by first opposite side walls 20 and second opposite side walls 22. The housing has a front mating end 24 and a rear end 26, with a plurality of terminal-receiving through passages 28 therebetween. A plurality of terminals (not visible in the drawings) are mounted within the passages, with contact portions projecting outwardly through rear end 26. The housing is adapted to be inserted through panel aperture 12 in the direction of arrows "A" from a first or rear surface 32 to at least a second or front surface 34 of the panel in order to mate with a complementary electrical component or connector (not shown) which will have terminal means insertable into terminal-receiving cavities 28. In the illustrated embodiment of the invention, mating end 24 of housing 18 is inserted through aperture 12, past second surface 34 of the panel.

Electrical connector assembly 16 includes complementary interengaging locking means between housing 18 and panel 14 to mount the housing in aperture 12. Specifically, the locking means is provided by a pair of cantilevered locking arms 36 molded integrally with housing 18 and projecting outwardly and forwardly from side walls 20. Each locking arm includes a hook portion 36*a* for snapping against second or front surface 34 of panel 14 when the housing is inserted into aperture 12 in the direction of arrows "A", as described in greater detail hereinafter. Housing 18 also includes a polarizing boss 38 projecting outwardly from one of the side walls 22, near mating end 24, for passing through a polarizing notch 40 at one edge of aperture 12. Boss 38 and notch 40 ensure proper orientation of the connector assembly within the aperture.

Still further, connector assembly 16, generally, includes resilient flange means surrounding a substantial portion of the periphery of housing 18 and which are adapted to bias a resilient lip (described hereinafter) of sealing boot 10 against rear surface 32 of the panel. More particularly, the resilient flange means are provided by four individual, elongated, resilient flanges 42 projecting outwardly from side walls 20 and 22 of the housing. The resilient flanges are unitarily molded with housing 18 by integral web portions or feet 44 with openings 45 therebetween. Therefore, the resilient flanges are flexible relative to the housing generally in the direction of doubleheaded arrow "B", i.e. generally parallel to housing side walls 20 and 22 and perpendicular to rear surface 32 of panel 14. It should be noted that the one locking arm 36 visible in FIG. 1 clearly shows how the locking arm projects through the adjacent resilient flange 42 toward panel 14. Therefore, the locking arms can latch behind front surface 34 of panel 14 and resilient flanges 42 can be biased against rear surface 32 of the panel.

Sealing boot 10 is generally rectangular in configuration, complementary to rectangular connector assembly 16, and includes a forward portion 50 and a rear portion 52. As will be more clear with the description of FIG. 2, hereinafter, rear portion 52 rigidly embraces rear end 26 of connector housing 18, and the rear portion includes a plurality of slots or openings 54 for passage therethrough of the terminals projecting from the rear of the connector housing. Forward portion 50 is generally rectangular and is adapted for surrounding resilient flanges 42 which project outwardly from the housing. Lastly, again as described in greater detail hereinafter, forward portion 50 includes an inwardly directed, continuous, resilient sealing lip 56 which will be sandwiched between resilient flanges 42 of connector assembly 16 and rear surface 32 of panel 14 when connector assembly 16 is assembled to the panel, with mating end 24 of the housing projecting through aperture 12 and latch arms 36 locking the connector assembly mounted to the housing in the aperture.

Figure 2:
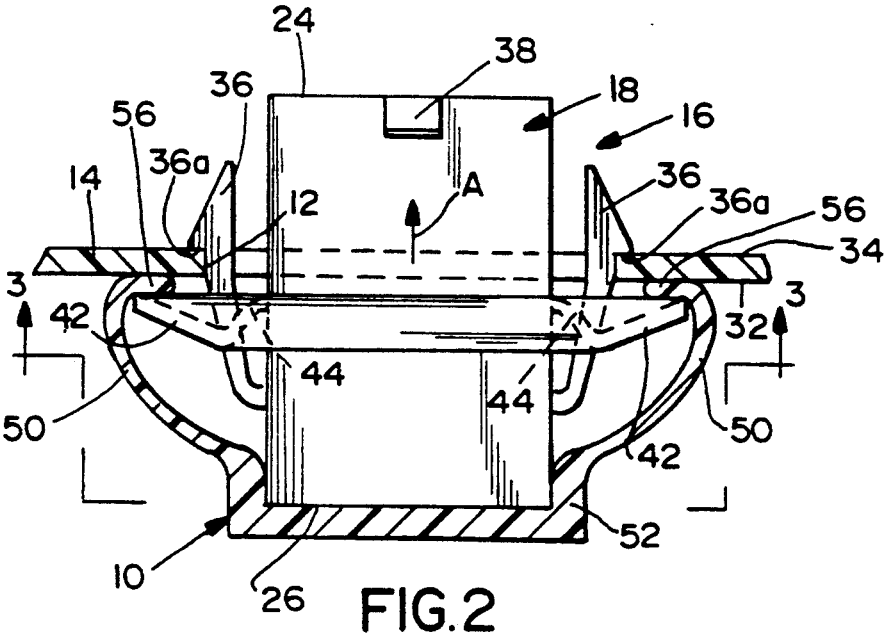
FIG. 2 is a vertical section through the panel and the sealing boot, illustrating the connector assembly mounted in an aperture in the panel.
Figure 3:
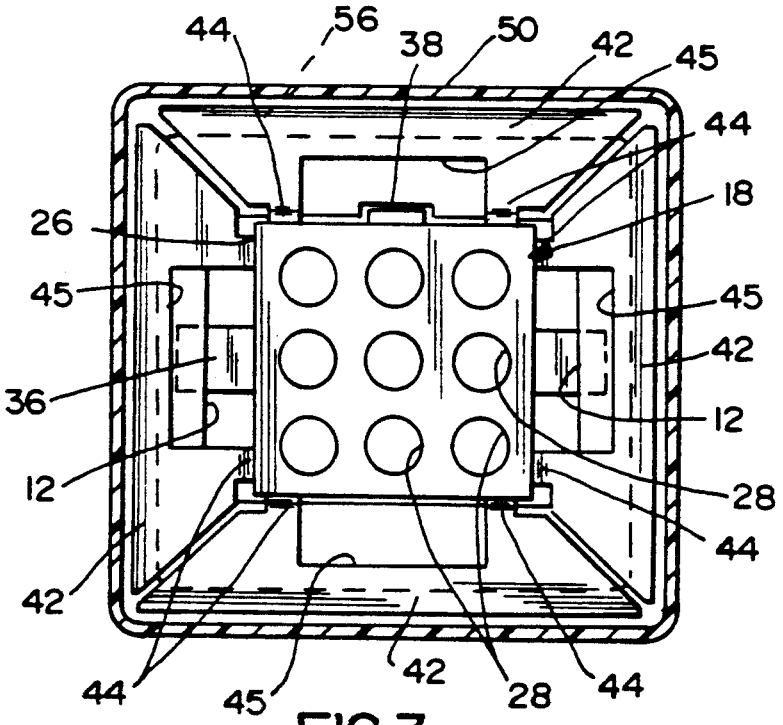
FIG. 3 is a horizontal section through the sealing boot as taken generally along line 3-3 of FIG. 2, but with a plan view of the connector housing to facilitate the illustration.

Now, referring to FIGS. 2 and 3, it can be seen particularly in FIG. 2 that the mating end 24 of connector housing 18 has been inserted through aperture 12 in panel 14, past front surface 34 of the panel. The connector assembly is inserted in the direction of arrow "A". When fully inserted, it can be seen that locking arms 36 project through aperture 12, and hook portions 36*a* are snapped behind front surface 34 of the panel to lock the connector assembly in its mounted position within the panel aperture. It also can be seen in FIG. 2 how the latch arms extend through openings 45 in resilient flanges 42 which project outwardly from housing 18.

Before housing 18 is inserted through panel aperture 12 as illustrated in FIG. 2, sealing boot 10 is assembled about the housing such that rear portion 52 of the boot rigidly embraces rear end 26 of the housing and forward portion 50 surrounds resilient flanges 42 of the housing. Peripheral resilient lip 56 is turned inwardly toward housing 18 and is sandwiched between rear surface 32 of panel 14 and resilient flanges 42 projecting outwardly of the housing. Therefore, the resilient flanges bias the lip portion against the rear surface of the panel and provide an environmental seal completely about aperture 12. Because of the resiliency of flanges 42, the flanges facilitate resilient lip 56 being effective to accommodate any irregularities in rear surface 32 of the panel.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a panel mounted, sealed electrical connector assembly for mounting in an aperture in a panel, said assembly including a connector housing having a front mating end adapted to be inserted through the aperture from a first surface to at least a second surface of the panel in order to mate with a complementary electrical component, complementary interengaging locking means between the housing and the panel to mount the housing in the aperture, and a sealing boot engaging the housing rearwardly of said first surface and extending toward and engaging the panel to surround and environmentally protect the aperture, wherein the improvement comprises resilient flange means surrounding a substantial portion of the periphery of the housing and adapted to be biased against the first surface of the panel, and the sealing boot includes a forward portion adapted to be received between the flange means of the housing and the first surface of the panel surrounding the aperture whereby the flange means resiliently biases the forward portion against the first surface and provides an environmental seal about the aperture.

2. In a panel mounted, sealed electrical connector assembly as set forth in claim 1, wherein said housing has a plurality of side walls, and said resilient flange means comprise a plurality of individual resilient flanges projecting outwardly from respective ones of the side walls.

3. In a panel mounted, sealed electrical connector assembly as set forth in claim 1, wherein said housing has at least two opposite side walls, and said locking means include a pair of locking members projecting from the side walls and extending through said flange means for locking engagement with the panel at the periphery of the aperture.

4. In a panel mounted, sealed electrical connector assembly as set forth in claim 1, wherein said locking means project from the housing through opening means in the resilient flange means.

5. In a panel mounted, sealed electrical connector assembly as set forth in claim 1, wherein said housing has a plurality of side walls, said resilient flange means comprise a plurality of individual resilient flanges projecting outwardly from respective ones of the side walls, and said locking means include a plurality of locking members projecting from the side walls and extending through opening means in the flanges for locking engagement with the panel at the periphery of the aperture.

6. In a panel mounted, sealed electrical connector assembly as set forth in claim 1, wherein said forward portion of the sealing boot comprises a resilient lip surrounding the aperture and turned inwardly toward the housing between the first surface and the flange means.

7. In a panel mounted, sealed electrical connector assembly as set forth in claim 1, wherein said sealing boot includes a rear portion surrounding the housing.

8. In a panel mounted, sealed electrical connector assembly as set forth in claim 7, wherein the housing includes a rear end, and said rear portion of the sealing boot is adapted to rigidly embrace the rear end of the housing.

9. A sealing system for an electrical connector assembly mountable in an aperture in a panel, comprising:

a connector housing having a front mating end and a rear end, the front mating end being adapted to be inserted through the aperture from a first surface past a second surface of the panel in order to mate with a complementary electrical connector, the housing having a plurality of side walls and including a plurality of individual resilient flanges projecting outwardly from respective ones of the side walls and adapted to be biased against the first surface of the panel, and at least a pair of locking members projecting from opposite side walls of the housing and extending through aperture means in respective ones of the resilient flanges for mounting the housing in the aperture, the locking members being engageable with the panel at the periphery of the aperture; and a sealing boot about the housing for environmentally protecting the aperture, the sealing boot including a rear portion adapted to rigidly embrace the rear end of the housing and a forward portion defining a resilient lip surrounding the aperture and turned inwardly toward the housing between the first surface of the panel and the resilient flanges projecting outwardly from the housing and providing an environmental seal about the aperture.

10. In a panel mounted, sealed electrical connector assembly for mounting in an aperture in a panel, said assembly including a connector housing having a front mating end adapted to be inserted through the aperture from a first surface to at least a second surface of the panel, locking means for securing the housing in the aperture, and a sealing boot engaging the housing rearwardly of said first surface, wherein the improvement comprises resilient means projecting outwardly of the housing and adapted to be resiliently biased against the first surface of the panel, and the sealing boot includes a forward portion adapted to be received between the resilient means of the housing and the first surface of the panel to resiliently bias the forward portion of the sealing boot against the first surface and provide an environmental seal about the aperture.

* * * * *